United States Patent [19]

McKee

[11] 3,971,351

[45] July 27, 1976

[54] FUEL METERING SYSTEM

[76] Inventor: T. R. McKee, P.O. Box 127, Baytown, Tex. 77520

[22] Filed: Sept. 23, 1974

[21] Appl. No.: 508,448

[52] U.S. Cl. ..... 123/119 R; 123/119 A; 123/124 R; 123/139 AA; 123/139 AW; 123/179 L

[51] Int. Cl.[2] ..... F02B 33/00

[58] Field of Search ..... 123/138, 139 AA, 139 AW, 123/139 BL, 139 BE, 139 BF, 119 R, 119 A, 119 D, 124 R, 179 L, 179 G

[56] References Cited

UNITED STATES PATENTS

| | | | |
|---|---|---|---|
| 1,098,047 | 5/1914 | Miles | 123/139 AA |
| 1,597,787 | 8/1926 | Hausser et al. | 123/138 |
| 1,623,501 | 4/1927 | Smith | 123/119 A |
| 1,676,563 | 7/1928 | LaPlant | 123/119 A |
| 1,716,252 | 6/1929 | Voll | 123/139 AA |
| 1,860,641 | 5/1932 | Woolson | 123/119 A |
| 2,074,437 | 3/1937 | Snyder | 123/138 |
| 2,950,095 | 8/1960 | Nystrom et al. | 123/179 L |
| 3,077,872 | 2/1963 | Allen | 123/139 BL |
| 3,498,274 | 3/1970 | Chapman | 123/139 AW |
| 3,557,765 | 1/1971 | Nystrom | 123/179 L |
| 3,638,631 | 2/1972 | Eheim | 123/179 L |
| 3,756,270 | 9/1973 | Fonseca et al. | 123/119 D |
| 3,809,035 | 5/1974 | Winton | 123/119 D |

*Primary Examiner*—Wendell E. Burns
*Assistant Examiner*—David D. Reynolds
*Attorney, Agent, or Firm*—Pravel & Wilson

[57] ABSTRACT

In an internal combustion engine, a fuel metering system having a metering apparatus for distributing charges of fuel from the fuel pump at predetermined intervals, and exhaust gas mixing device for mixing exhaust gas from the exhaust manifold with charges of fuel and a fresh air mixing device for mixing fresh air with the charges of fuel.

7 Claims, 4 Drawing Figures

S
38
46
42
44
18
14c
40
40a
14
14c
16
14b
18
2
10
62
60
56
64b
50
12
64
54
64a
52
20
M
58
E
72
F
74
70
76
66
2
68
88
102
92
I
90
94
110
100
98
96

FUEL METERING SYSTEM

BACKGROUND OF THE INVENTION

The field of this invention is fuel metering devices, particularly of the type used in conjunction wit internal combustion engines.

Prior art fuel metering systems for internal combustion engines include such devices as those disclosed in the U.S. Pat. Nos.: 2,851,026; 2,482,956; and 2,157,034.

Numerous disadvantages are found in the prior art devices such as complicated pumping structures and their associated injectors, complex fuel distribution networks, as well as substantial economic considerations attendant thereto the manufacturing thereof.

SUMMARY OF THE INVENTION

The present invention relates to a new and improved fuel metering system adapted to be used with an internal combustion engine. The fuel metering system of this invention includes a metering apparatus having a housing with a cavity formed therein and a plurality of cam-actuated valves in communication therewith for distributing charges of fuel at predetermined intervals. An exhaust gas mixing device and a fresh air mixing device mix exhaust gas from the exhaust manifold and fresh air, respectively, with the charges of fuel so distributed at the predetermined intervals.

DESCRIPTION OF THE PREFERRED EMBODIMENT

Figure 1:
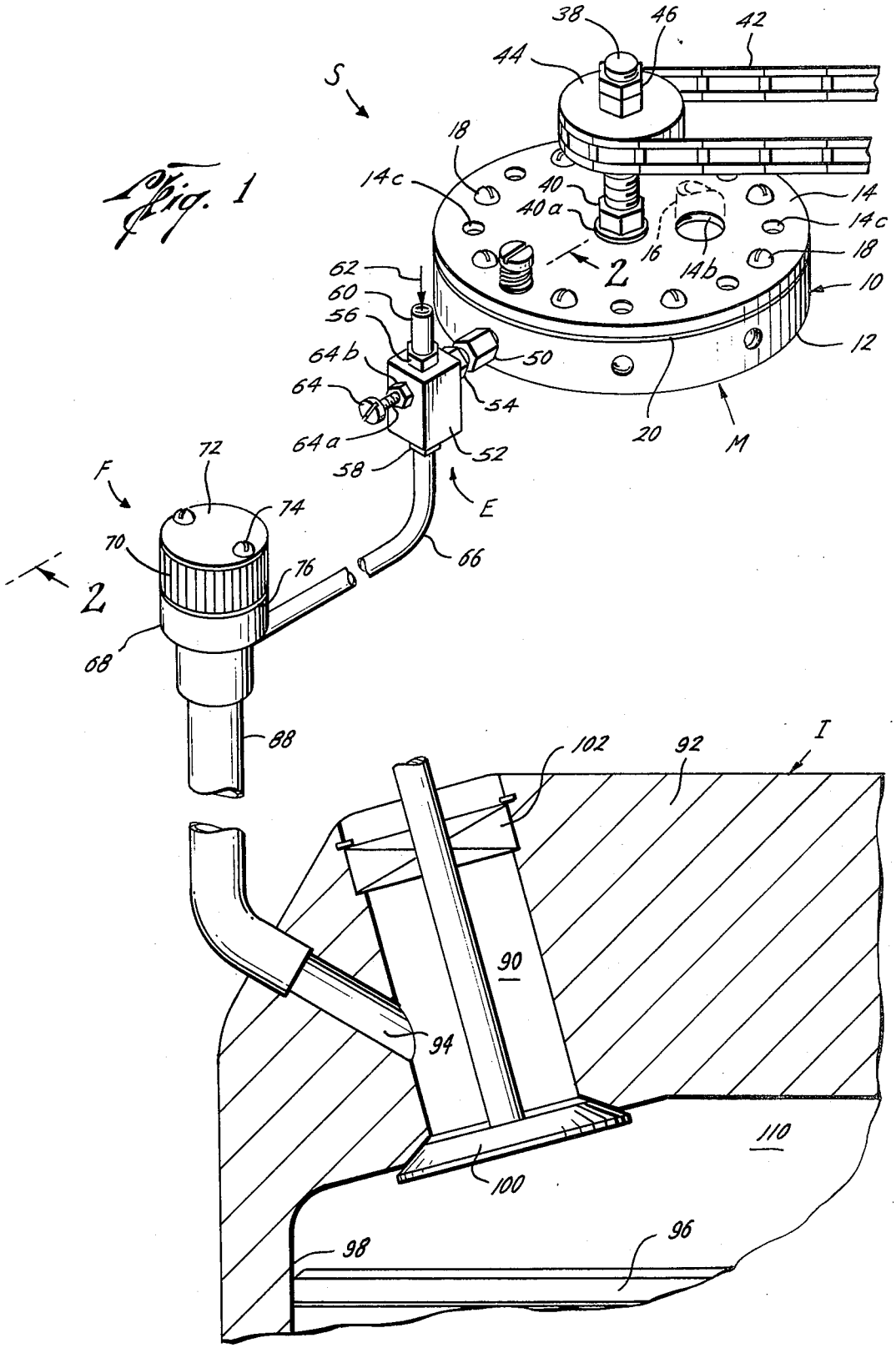
FIG. 1 is an isometric view of the fuel metering system of the present invention as used with an internal combustion engine.

Referring to the drawings, the letter S designates the fuel metering system of the preferred embodiment of this invention. The fuel metering system S includes a metering apparatus M, and exhaust gas mixing means E and a fresh air mixing means F. The fuel metering system S is to be used in conjunction with an internal combustion engine I for metering charges of fuel at predetermined intervals to be mixed with exhaust gas and fresh air for proper combustion thereof in the internal combustion engine I.

The fuel metering system S includes a metering apparatus M having a housing 10 of preferably a circular, disc-like configuration. The housing 10 includes a base portion 12 and a top member 14.

The base portion 12 of the housing 10 has a cavity 12*a* (FIG. 2) formed therein having preferably an annular ring-shaped configuration, but may be of any other suitable configuration. The cavity 12*a* has an inner annular surface 12*b*, a base 12*c* and an outer annular surface 12*d*. A plurality of passageways 12*e* are formed adjacent to outer annular surface 12*d* extending therebetween cavity 12*a* and opening 12*f* formed in the base portion 12. The opening 12*f* is generally of a conical configuration as will be more fully discussed hereinbelow. Passage 12*g* in axial alignment with passageway 12*c* is in communication with opening 12*f* and extends outwardly therefrom the base portion 12. A central opening 12*h* is formed centrally thereof the base portion 12 as will be more fully discussed hereinbelow.

The top member 14 of the housing 10 of the metering apparatus M includes a central opening 14*a* of similar diameter as central opening 12*h* of the base portion 12. A fuel opening 14*b* is formed in the top member 14 such that the fuel opening 14*b* is above, and adjacent to cavity 12*a* formed in base portion 12. Fuel opening 14*b* receives fuel line 16 from the fuel pump (not shown) of the internal combustion engine I. A plurality of bolt holes (not numbered) are formed in the top member 14 to accommodate suitable connectors 18 such as bolts, screws or the like, for securing the top member 14 to the base portion 12 of the housing 10. Preferably, the connectors 18 are disposed in equal radial disposition from the central opening 14*a*. Equally spaced therebetween connectors 18 are plural valving holes 14*c* formed in top member 14 corresponding to the conical configuration of openings 12*f* formed in the base portion 12.

The top member 14 is bolted by connectors 18 to the base portion 12 having a gasket 20 preferably formed of neoprene, paper, or other suitable fuel-resistant materials disposed therebetween. The gasket 20 has openings formed therein that are similar in configuration and location corresponding to those formed in the top member 14. Central opening 20*a* and valving holes 20*b* and connector holes (not numbered) for connectors 18 are appropriately formed in the gasket 20.

A plurality of cam-actuated valving means 22 are mounted with the housing 10 of the metering apparatus M. The cam-actuated valving means 22 includes a plurality of valving members 24 and a camming means 26. The valving members 24 include valve bodies 28 having preferably a truncated-conical configuration with a central opening 28*a* formed therein. The outer surface 28*b* of valve body 28 movably engages the valving holes 14*c*, 20*b*, 12*f* formed in the top member 14, gasket 20, and base portion 12, respectively. The valve body 28 is mounted with the metering apparatus M by inserting the valve body 28 into the valving holes 12*f*, 20*b*, 14*c*, respectively and thereafter connecting the same to the top member 14 of the housing 10 by connectors 30 such as screws, bolts or the like having preferably a spring 30*a* disposed between plural washers 30*b*, 30*c*. Washer 30*b* engages top portion 14 adjacent to valving hole 14*c* with the spring 30*a* placed thereon, with the washer 30*c* thereafter constraining the spring 30*a*, with connector 30 holding the same in a proper position while engaging upper end 28*c* of valve body 28 at threaded portion 28*d*. This connection of the valve body 28 with the metering apparatus M allows the valve body to rotate with respect to the housing 10 while maintaining the valve body 28 at a proper elevation and engagement therein.

A reduced collar 28*e* and an annular lip 28*f* are formed adjacent the lower end 28*g* of the valve body 28. A rocker arm 32 has a mounting hole 32*a* formed therein for mounting the rocker arm 32 with the valve body 28. The rocker arm 32 is mounted with the valve body 28 by positioning mounting hole 32*a* with the reduced collar 28*e* and adjacent to annular lip 28*f* and, preferably threadedly connecting thereto by connectors 34 such as screws, bolts or the like with a washer 34*a* therewith, engaging the lower end 28*g* of the valve body 28.

The camming means 26 includes a lobed cam 36 and a shaft 38 for rotating the same. The shaft 38 is adapted to be disposed in central openings 12*h*, 20*a*, 14*a* formed in base portion 12, gasket 20, top member 14, respectively. Preferably, the shaft 38 has threads 38*a* formed thereon. The shaft 38 is mounted with the housing 10 adjacent top member 14 by preferably a bolted connector 40 and a washer 40*a* therewith. The shaft 38 is mounted adjacent the base portion 12 by bolted connectors 42, washer 42*a* having a cam 36 therewith. In such bolted configuration as hereinabove described, the shaft 38 is rotatively mounted with the housing 10.

The shaft 38 is preferably powered by a chain 42 that is operably connected to the distributor (not shown) of the internal combustion engine I. The chain 42 engages sprocket 44 which is mounted to shaft 38 by plural bolts 46. Thus, when the distributor (not shown) of the internal combustion engine I rotates, the chain 42 being operatively connected thereto simultaneously rotates the sprocket 44 which in turn rotates shaft 38 having the cam 36 therewith.

Cam 36 (FIG. 3) includes a lobed-portion 36*a* with an actuating flat surface 36*b*, ascending and descending portions 36*c*, 36*d*, respectively, and an annular ring 36*e* therewith. Thus, the camming surface of the cam 36 is a substantially circular configuration having an ascending portion 36*c*, an actuating flat surface 36*b*, a decending portion 36*d*, and an annuler ring 36*e* connecting the ascending and decending portions 36*c*, 36*d* therebetween.

Figures 2, 3:
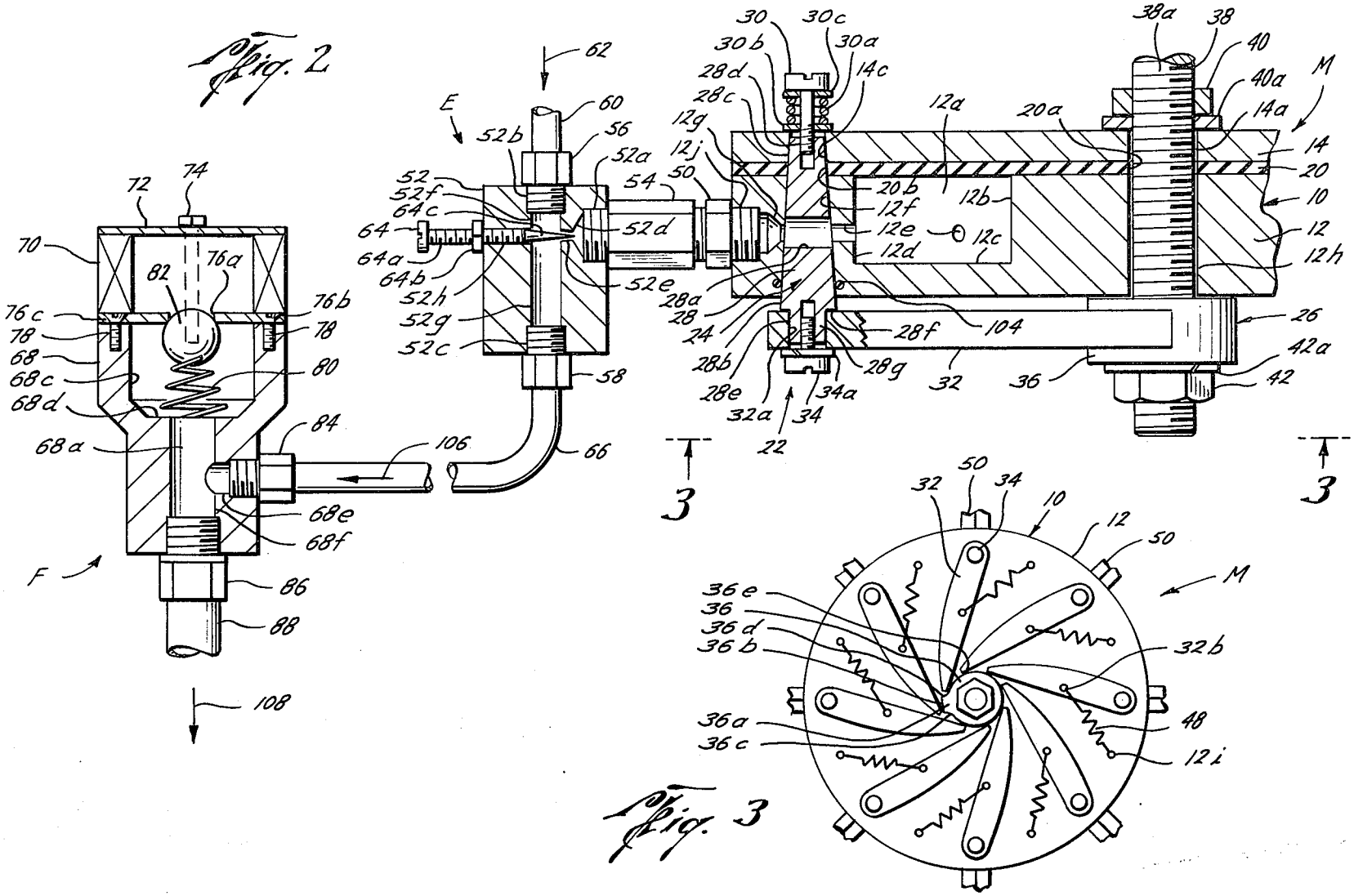
FIG. 2 is a side view, partly in section, showing the fuel metering system of the present invention along the lines 2—2 of FIG. 1.
FIG. 3 is a bottom view along the lines 3—3 of FIG. 2 of the fuel metering apparatus of the present invention; and, FIG. 4 is a side view, partly in section, partly schematic, showing the idling and starting system to be used with the fuel metering apparatus of the present invention.

With the valving members 24 in position as described hereinabove with housing 10 and having rocker arms 32 mounted therewith, and the cam 36 being suitably mounted to shaft 38 as mounted with housing 10, the rocker arms 32 are held movably against the camming surface by return springs 48 (FIG. 3). The return springs 48 are mounted to the base portion 12 by tabs 12*i* and to the rocker arms 32 by tabs 32*b*. As such, the return spring 48 holds the rocker arm 32 adjacent to the camming surfaces of the cam 36 as the cam 36 rotates with shaft 38. When the rocker arm 32 is adjacent to the annular ring 36*e* of the cam 36, the valve body 28 is positioned such that the opening 28*a* formed therein is not in fluid communication with passageway 12*e* formed within the base portion 12, thus hindering flow of fuel therebetween the cavity 12*a* and passageway 12*e*. However, as the cam 36 rotates in a counterclockwise direction as viewed in FIG. 3, the rocker arm moves in accordance with the ascending portion 36*c* of cam 36 onto the flat actuating surface 36*b*, wherein the rocker arm 32 being rigidly affixed to the valve body 28 suitably rotates the valve body 28 such that the opening 28*a* formed therein allows fluid communication and flow from cavity 12*a* through passageway 12*e* through opening 28*a* into passageway 12*g*. While the rocker arm 32 remains in engagement with the flat actuating surface 36*b*, the valving members 24 remain open. Thereafter, the rocker arm follows the descending portion of cam 36 onto the annuler ring 36*e* wherein the valving members 24 are in a closed position.

The exhaust gas mixing means E includes a body member 52 having threaded couplings 54, 56 and 58 mounted thereto at threaded body portions 52*a*, 52*b*, 52*c*, respectively. Threaded coupling 54 connects to tubular connector 50 mounted with the threaded portion 12*j* formed in base portion 12 adjacent to passageway 12*g* thereby mounting the body member 52 with the housing 10. Appropriately formed openings (not numbered) are formed within the tubular connector 50, threaded coupling 54 to allow fluid flow therethrough. The body member 52 has passageways 52*d*, 52*e*, 52*f*, 52*g* formed therein. Passageway 52*d* is in communication with the openings (not numbered) within the tubular connector 50 and threaded coupling 54 with the passageway 52*d* being of preferably a funnel-type configuration. Passageway 52*d* connects to passageway 52*e* discussed more fully hereinbelow. Passageway 52*e* connects with both passageways 52*f*, 52*g* within the body member 52.

Threaded coupling 56 connects to exhaust gas line 60 which connects to the exhaust manifold (not shown) of the internal combustion engine I, with flow from the exhaust manifold designated generally by arrow 62. Threaded opening 52*h* is formed in body member 52 to accommodate threaded needle 64 having a threaded shank 64*a*, lock nut 64*b* and pointed portion 64*c*. Passageway 52*e* preferably conforms to the shape of pointed portion 64*c* of the needle 64 such that an adjustable needle valve is in effect constructed. Thus, the amount of fuel entering the body member 52 is adjusted by the relative position of the pointed portion 64*c* of the needle 64 with respect to the passageway 52*e*. The fuel flowing through the passageway 52*e* then combines with exhaust gas flowing as per arrow 62 from passageway 52*f* into passageway 52*g*. This mixture of a charge of fuel and exhaust gas exits the body member 52 from threaded coupling 58 which attaches the body member 52 to connecting line 66.

The fresh air mixing means F include a mixing housing 68 having a mixing chamber 68*a* formed therein. An air filter 70 is mounted adjacent the upper end 68*b* of the mixing housing 68 by an appropriate mounting cover 72 and bolted connectors 74 therewith. Disposed between the air filter 70 and the mixing housing 68 is a gasket 76 having an opening 76*a* formed centrally thereof and openings 76*b*, 76*c* formed to mount the gasket 76 with the upper end of 68*b* of the mixing housing 68 by suitable connectors 78, such as screws or the like. Disposed within chamber 68*c* within the mixing housing 68 is a spring 80 and a spherical ball 82. The spring 80 rests upon surface 68*d* within chamber 68*c* and supports the ball 82 against the gasket 76 at central opening 76*a* thus preventing air flow from chamber 68*c* into the air filter 70 while allowing flow from air filter 70 into chamber 68*c*. Chamber 68*c* is in fluid communication with mixing chamber 68*a* as are passageways 68*e*, 68*f*. Passageway 68*e* communicates with connecting line 66 through threaded coupling 84 which attaches connecting line 66 thereto the mixing housing 68. In similar fashion, threaded coupling 86 connects passageway 68*f* with fuel charge line 88.

Fuel charge line 88 connects the fresh air mixing means F with the intake port 90 formed with the cylinder head 42 by tube 94 of the internal combustion engine I. The intake port 90 provides a sealed chamber for receiving the mixture of vaporized fuel, hot exhaust gas, and fresh air from the fresh air mixing means F through tube 94, providing all of the necessary combustible ingredients for powering the internal combustion engine I. The internal combustion engine I further includes piston 96 disposed within a cylinder wall 98 and an intake valve 100 mounted with the cylinder head 92 by suitable valve guides 102.

In the use or operation of the fuel metering system S of the present invention, the housing 10 being connected to the fuel pump (not shown) by a fuel line 16 receives fuel under pressure therefrom. Fuel is directed through fuel opening 14*b* into cavity 12*a* filling the same. By appropriately timing the metering apparatus M with the distributor (not shown) by chain 42, the shaft 38 having the cam 36 therewith rotates thereby actuating rocker arm 32 which in turn rotates valve body 28 from a closed position to an open position. Gasket portions 20*b* and O-ring 104 suitably mounted in base portion 12 prevent leakage of fuel between adjacent surfaces of opening 12*f* in the base portion 12 and outer surface 28*e* of the valve body 28. In the open position, the valve body permits fluid flow from the cavity 12*a* through passageways 12*e* through opening 28*a* into passageway 12*g* and outwardly therefrom into tubular connector 50. Threaded coupling 54 connects the tubular connector 50 to the exhaust gas mixing means E such that the metered charges of fuel flow therethrough and into passageway 52*d* formed with body member 52. Appropriate positioning of needle 64 within passageway 52*e* limits the amount of fuel capable of entering passageway 52*g*. This charge is mixed with incoming hot exhaust gas from the exhaust manifold (not shown) flowing in the direction of arrow 62 through exhaust gas line 60, threaded coupling 56, passageway 52*f* and into passageway 52*g* wherein the exhaust gas and charge of fuel mix theretogether. The charge, as such, exits the exhaust mixing means E through the connecting line 66 in the direction as designated by arrow 106. The connecting line 66 directs this mixture into the fresh air mixing means F.

For proper operation of the fuel metering system S thereof, at this point, it is necessary that the intake valve 100 begin to open while the piston 96 moving within the cylinder walls 98 begins a downward stroke thereby forming a vacuum within the intake port 90, tube 94, fuel charge tube 88, through threaded coupling 86 into mixing chamber 68*a*. The vacuum acting in the direction of arrow 108 draws fresh air through the air filter 70 past the spherical ball 82-spring 80 check valve assembly and chamber 68*c* into mixing chamber 68*a* where the fresh air mixes with the fuel charge-exhaust gas mixture as entering in the direction of arrow 106. The vacuum acting in the direction of 108 draws this entire mixture of fuel charge, hot exhaust gas, and fresh air into the intake port 90 and thereafter into the combustion chamber 110 of the internal combustion engine I.

This mixture is thus a combustable charge useful in powering the internal combustion engine I. Preferably, the fuel metering system S as hereinabove described requires a single metering apparatus M while plural exhaust gas mixing means E and fresh air mixing means F correspond to the number of cylinders within the internal combustion engine I. As is shown in FIGS. 1–3, the fuel metering system S is shown having capabilities for an eight cylinder, internal combustion engine I. However, it will be appreciated that by reducing the number of valving members 24 within the housing 10 and the corresponding number of exhaust gas mixing means E and fresh air mixing means F, the fuel metering system S of the present invention can be easily incorporated to accommodate for a six cylinder internal combustion engines as well as any other engines having varying numbers of cylinders thereof.

Figure 4:
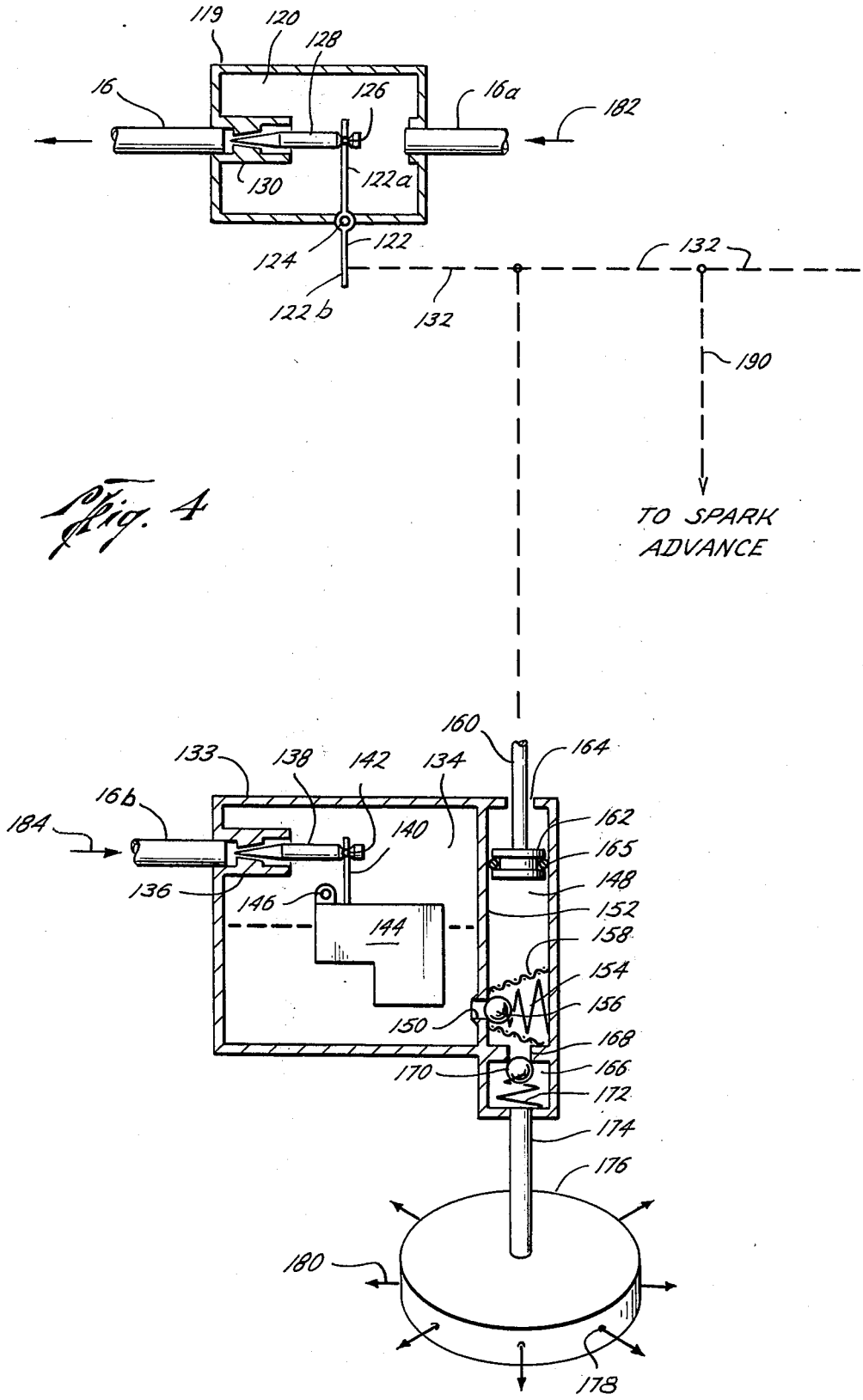

FIG. 4 shows that portion of the present invention necessary for using the fuel metering system S with an internal combustion engine I such that the internal combustion engine I starts easily, idles well, and provides the necessary "boost" under such high load conditions such as passing, hauling, and the like.

Preferably, the fuel pump (not shown) has twin outlet lines 16*a*, 16*b*. Outlet line 16*a* is affixed to housing 119 with chamber 120 therein having suitable means therewith for attaching the line 16*a* in fluid communication therewith. Pivot arm 122 is appropriately mounted with the housing 119 and chamber 120 at pivot 124 and suitably sealed therewith to prevent fuel leakage therefrom. Upper pivot arm 122*a* has preferably an appropriate slot or pivot 126 formed therein and adapted to movably receive needle valve 128 therewith which seats in seating member 130 formed with housing 119. Line 16 from chamber 120 is mounted adjacent the needle valve 128-seating member 130 arrangement and directed to the metering apparatus M of the prevent invention, and connected thereto as shown in FIG. 1. Lower portion 122*b* of pivot arm 122*a* is appropriately attached to the schematically shown accelerator control arm 132 which preferably is mounted with the throttle or accelerator of the engine I of the vehicle.

Fuel pump outlet line 16*b* is mounted with housing 133 having a chamber 134 therein, preferably with line 16*b* being mounted adjacent to the upper end thereof the chamber 134. Seating member 136 is formed adjacent to the mounted fuel pump line 16*b* with the interior of the chamber 134, and is adapted to movably receive needle valve 138. Needle valve 138 is pivotally mounted with arm 140 at pivot 142, with arm 140 being mounted to float 144 being pivotally disposed within chamber 134 by pivot 146.

Housing 133 has chamber 148 formed adjacent to chamber 134, having fluid communication therebetween by aperture 150 formed in wall 152. A check valve, such as one having a spring 154 and ball 156 mounted within suitable constraining means 158 operates to allow one way flow therebetween chambers 134, 148. Plunger arm 160 having plunger end 162 affixed thereto is disposed within the chamber 148. Suitable opening 164 is formed in the housing 133 to allow vertical movement of plunger arm 160 with respect to the housing 133. Suitable sealing means 165, such as an O-ring or the like, is mounted with plunger end 162 to prevent fluid leakage therebetween plunger end 162 and the interior walls of chamber 148. Plunger arm 160 is suitably attached to accelerator control arm 132.

Chamber 166 formed within housing 133 is disposed adjacent to the lower end of chamber 148 having aperture 168 allowing fluid migration therebetween. A check valve having preferably a ball 170 and spring 172 arrangement is suitable disposed within chamber 166 to allow one way fluid flow therethrough. Line 174 mounted with the chamber 166 connects chamber 166 with distributing disk 176. Distributing disk 176 has preferably a plurality of machined passageways 178 formed therein which allow incoming fuel flowing through line 174 to be dispersed radially outwardly in the directions of arrows 180. Preferably, distributing disk passageways 178 are suitably connected with fuel charge line 88 (FIG. 1), hence with internal combustion engine I.

Chamber 120 is filled with fuel entering in the direction of arrow 182, flowing through line 16*a*. Fluid pressure exerted by the fuel pump (not shown) keeps chamber 120 filled with fuel. Pivot arm 122 having needle valve 128 movably mounted therewith, regulates the amount of fuel flowing into the metering apparatus M of the present invention. Thus, movement of accelerator control arm 132 causes pivotal response of pivot arm 122 thus removing needle valve 128 from seating member 130, thus allowing fuel to flow therefrom chamber 120 into the metering apparatus M of the present invenion.

Fuel flowing from the fuel pump (not shown) in the direction of arrow 184 enters chamber 134 within housing 133 by flowing through line 16*b*. Fuel pressure developed by the fuel pump (not shown) allows fuel to fill chamber 134 until the fuel level is such that float 144 has sufficient upward buoyant force acting upon arm 140 mounted therewith. Needle valve 138 pivotally mounted with arm 140 prevents fuel flow into chamber 134 when the same seats in seating member 136.

Upward movement of plunger arm 160 during release of the control arm 132 by an appropriate return spring arrangement (not shown) with the plunger arm 160 being sealably mounted within chamber 148, activates the release of the ball 156-spring 154 check valve assembly thus allowing fuel to flow from chamber 134 into chamber 148 in response to an upstroke of plunger arm 160. Upon downstroke action of plunger arm 160 caused by positive action of control arm 132, the ball 170 and spring 172 check valve assembly opens in response to fluid being forced from chamber 148 through aperture 168 into chamber 172, into and through line 174 into distributing disk 176. Downstroke action of plunger arm 160 thus forces a charge of fuel into each passageway 178 formed within distributing disk 176, hence charging all fuel charge lines 180 simultaneously.

Thus, the starting system serves to regulate the amount of flow of fuel into the metering apparatus M while simultaneously charging all cylinders with fuel from the distributing disk 176. Furthermore, preferably the accelerator control arm 132 is still further affixed to a spark advance 190 of the distributor (not shown) such that in response to action of the accelerator control arm 132 thereof, the distributor spark is advanced to facilitate easy starting of the internal combustion engine I. Thus, when one seeks to start the internal combustion engine I, movement of an accelerator pedal (not shown), having an accelerator control arm 132 affixed thereto, allows fuel within chamber 120 to flow into the metering apparatus M, while simultaneously injecting fuel from the distributing disk 176, and advancing the spark, hence resulting in a "rich" mixture having a "choking" effect on the internal combustion engine I.

It will appreciated that this starting-idling system is activated, preferably, by movement of accelerator control arm 132 beyond a designated level at which point both the plunger arm 160 and the spark advance 190 of the distributor are activated. The accelerator control arm 132 is at all times affixed and operable with the chamber 120 with the same having suitable means therewith to prevent total seating of needle valve 128 with seating member 130, which is necessary to allow sufficient fuel to flow therethrough to permit proper idling of internal combustion engine I. During normal operation of internal combustion engine I in response to various conditions, the pivot arm 122 responds to any and all such movements of accelerator control arm 132. For the plunger arm 160 and the spark advance 190 to the distributor to be operative, accelerator control arm 132 must move beyond a preset, designated position. For example, as used with an automobile, in starting and/or passing situations, movement of the accelerator (not shown) from a three-quarters to wide-open throttle would preferably activate both the plunger arm 160 to inject fuel into fuel charge lines 88 and spark advance 190 to not only increase the charge of fuel into each cylinder but also adjust the timing in response thereto.

The foregoing disclosure and description of the invention are illustrative and explanatory thereof, and various changes in the size, shape and materials as well as in the details of the illustrated construction may be made without departing from the spirit of the invention.

I claim:

1. In an internal combustion engine having an exhaust manifold, a cylinder head with intake ports, a distributor, and a fuel pump, the improvement comprising a fuel metering system including:

a metering apparatus mounted with the fuel pump including:

a housing having a cavity formed therein, said cavity receiving pressurized fuel from the fuel pump;

a plurality of cam-actuated valving means in fluid communication with said cavity for distributing charges of fuel from said cavity at predetermined intervals;

exhaust gas mixing means mounted adjacent to said housing of said metering apparatus for mixing said charges of fuel with exhaust gas from the exhaust manifold to preheat and vaporize said charges of fuel, said exhaust gas mixing means having needle valve means for adjustably regulating the relative proportions of said charges of fuel with the exhaust gas from the exhaust manifold in proper ratios thereof;

fresh air mixing means mounted with said metering apparatus for mixing fresh air with said charges of fuel, said fresh air mixing means having a mixing housing having a mixing chamber formed therein for mixing said vaporized charge of fuel-exhaust gas mixture with fresh air, to provide a combustable charge of fuel directed to the intake ports with the cylinder head; and, means for promoting ease of starting of the internal combustion engine and for providing the necessary boost for the internal combustion engine under high load conditions, said starting means mounted with said metering apparatus and the internal combustion engine.

2. The improvement of claim 1, wherein said cam-actuated valving means includes:

a plurality of valving members mounted with said housing, each of said valving members being movable from a closed position to an open position and in fluid communication with said cavity; and camming means with said housing for moving said valving members from said closed position to said open position at said predetermined intervals, said camming means having a shaft mounted with said housing and operatively connected to the distributor and a lobed cam rotatively mounted on said shaft for moving said valving members from said closed position to said open position at said predetermined intervals.

3. The improvement of claim 1 wherein said cam-actuated valving means includes:

a plurality of valving members mounted with said housing, each of said valving members being movable from a closed position to an open position and in fluid communication with said cavity;

camming means with said housing for moving said valving members from said closed position to said open position at said predetermined intervals;

each of said valving members having a valve body of a substantially truncated, conical configuration having an opening formed therein, said opening allowing fuel to flow from said cavity to said exhaust gas mixing means when said valve body is in said open position;

a rocker arm mounted with said valve body adjacent the exterior of said housing, said rocker arm actuated by said camming means to rotatively move said valve body from said closed position to said open position; and, return springs to return said valve body from said open position to said closed position.

4. The improvement of claim 1, wherein said mixing housing further includes:

check valve means for allowing intake fresh air into said mixing chamber when said charge of fuel-exhaust gas mixture is therein and for preventing said mixture from flowing outwardly therefrom said check valve means.

5. The improvement of claim 1, wherein said starting means includes:

a chamber having means for storing and regulating the fuel flow into said metering apparatus, said first chamber mounted with said metering apparatus.

6. The improvement of claim 1, wherein said starting means includes:

a housing having a first chamber having means for storing and regulating the flow of incoming fuel;

said housing having a second chamber having plunger means movably mounted therewith for withdrawing fuel from said first chamber; and said housing having a third chamber to receive fuel withdrawn from said second chamber and to direct the fuel outwardly from said third chamber of said housing by positive pressure action of said plunger means within said second chamber for distributing fuel simultaneously to all cylinders of the internal combustion engine.

7. The improvement of claim 6, wherein said starting means further includes:

spark advance means for appropriately advancing and retarding the spark timing of the internal combustion engine, said spark advance means being operatively connected with said plunger means to promote ease in starting.

* * * * *